US006698834B2

(12) United States Patent
Olarte

(10) Patent No.: US 6,698,834 B2
(45) Date of Patent: Mar. 2, 2004

(54) SEAT CONNECTION MECHANISM

(75) Inventor: Alvaro Mauricio Olarte, Aventura, FL (US)

(73) Assignee: Multiple LLC, Aventura, FL (US)

( * ) Notice: Subject to any disclaimer, the term of this patent is extended or adjusted under 35 U.S.C. 154(b) by 0 days.

(21) Appl. No.: 10/067,381

(22) Filed: Feb. 5, 2002

(65) Prior Publication Data

US 2003/0090136 A1 May 15, 2003

Related U.S. Application Data

(60) Provisional application No. 60/346,097, filed on Nov. 9, 2001.

(51) Int. Cl.[7] ..... A47C 1/02

(52) U.S. Cl. ..... 297/335; 297/331

(58) Field of Search ..... 297/335, 331, 297/411.32; 403/119, 120, 113, 112, 116, 117

(56) References Cited

U.S. PATENT DOCUMENTS 3,098,677 A * 7/1963 Williams ..... 16/289
3,589,762 A * 6/1971 Henrikson ..... 297/324
3,641,614 A * 2/1972 Newsome ..... 15/250.32
4,297,763 A * 11/1981 Lautenschlager ..... 16/363
4,330,898 A * 5/1982 Thompson et al. ..... 15/250.32
4,865,377 A * 9/1989 Musser et al. ..... 296/65.03
5,033,792 A * 7/1991 Kanazawa ..... 297/411.32
5,282,662 A * 2/1994 Bolsworth et al. ..... 296/65.03
5,375,914 A * 12/1994 Donnelly ..... 297/335
5,658,043 A * 8/1997 Davidson ..... 297/113
5,702,157 A * 12/1997 Hurite ..... 297/411.38
5,733,010 A * 3/1998 Lewis et al. ..... 297/411.32
6,019,413 A * 2/2000 Scraver et al. ..... 296/66
6,283,550 B1 * 9/2001 Vialatte et al. ..... 297/335

* cited by examiner

*Primary Examiner*—Peter M. Cuomo
*Assistant Examiner*—Stephanie Harris
(74) *Attorney, Agent, or Firm*—St. Onge, Steward, Johnston & Reens

(57) ABSTRACT

A seat connection mechanism having a saddle bracket portion and a pin portion is provided. The saddle bracket portion includes an inner pivot channel, an occupied position stop, an unoccupied position stop, and an outer surface which extends between the occupied and the unoccupied position stops. The pin portion includes a pivot pin and a stop pin protruding therefrom. The pivot and stop pins are positioned such that, and are spaced apart by a distance such that, when the pin portion is angled with respect to the saddle bracket portion at an insertion angle, the stop pin is positionable adjacent to the outer surface and the pivot pin is insertable into the inner pivot channel, and such that when the pin portion is angled with respect to the saddle bracket portion at an angle other than the insertion angle, the pivot pin is retained in the inner pivot channel.

50 Claims, 8 Drawing Sheets

SEAT CONNECTION MECHANISM

RELATED APPLICATIONS

This patent application claims the benefit of, under 35 U.S.C. 119(e), U.S. Provisional Patent Application No. 60/346,097, filed Nov. 9, 2001.

FIELD OF THE INVENTION

The present invention relates to an improved saddle bracket for use with seat assemblies, and more particularly for use with seat assemblies such as those typically found in auditoriums, theaters or the like.

BACKGROUND OF THE INVENTION

Auditorium seating typically includes a seat and a back mounted to a frame assembly, with the back being fixed and the seat being pivotable throughout a range of movement. Typically, this pivotable connection between the seat and frame is achieved through the use of an axle and cooperating bushing or the like, or by some complex hinge mechanism.

A disadvantage of such connection mechanisms is that they typically require complex assembly and disassembly procedures, often requiring the use of tools. This is undesirable for several reasons. First, complex assembly procedures may increase the costs associated with initial assembly. In the case of a large auditorium or theater having numerous seat assemblies, this cost may be significant. It would be far more desirable if the seat could be installed within the frame quickly and simply. Second, the seat surfaces, which typically comprise some type of cloth material, may need to be cleaned and/or replaced after extended use, or after being subject to a spill or the like. If the seat connection mechanism requires complex assembly and disassembly procedures, it would be necessary to have a skilled mechanic remove the seat from the frame simply to replace the seat or to remove the seat for cleaning. It would be far more desirable if the seat could be removed and replaced by an unskilled worker.

However, while complex assembly and disassembly procedures are undesirable for the reasons set forth above, it would also be undesirable if the procedure for seat removal was obvious to the general public. For example, seats of the type disclosed herein are typically used in auditoriums in schools. If the procedure for removing the seat from the frame were obvious to the students of the school, it is likely that seats may be undesirably by removed by students without valid reasons for so removing the seats.

Furthermore, when complex hinge mechanisms or the like are employed, individual components thereof may come loose after extended use and become lost. This problem may be exacerbated by vandals purposely removing components of the mechanism. Therefore, a connection mechanism with few components would be desirable.

Moreover, a further disadvantage of known connection mechanisms is that they may become clogged with dirt, debris or other undesirable objects, which deleteriously affect operation of the mechanism. This problem is exacerbated when the seat assemblies are employed at venues which serve food. It would therefore be desirable if the connection mechanism included some means which inhibited undesirable objects from interfering with the operation thereof.

What is desired, therefore, is a seat connection mechanism which does not require complex assembly and disassembly procedures, which does not employ a procedure for seat removal which is obvious to the general public, which has few components, and which inhibits undesirable objects from interfering with the operation thereof.

SUMMARY OF THE INVENTION

Accordingly, it is an object of the present invention to provide a seat connection mechanism which does not require complex assembly and disassembly procedures.

Another object of the present invention is to provide a seat connection mechanism having the above characteristics and which does not employ a procedure for seat removal which is obvious to the general public.

A further object of the present invention is to provide a seat connection mechanism having the above characteristics and which has few components.

Still another object of the present invention is to provide a seat connection mechanism having the above characteristics and which inhibits undesirable objects from interfering with the operation thereof.

These and other objects of the present invention are achieved by provision of a seat connection mechanism having a saddle bracket portion and a pin portion. The saddle bracket portion includes an inner pivot channel, an occupied position stop, an unoccupied position stop, and an outer surface which extends between the occupied position stop and the unoccupied position stop. The pin portion includes a pivot pin and a stop pin protruding therefrom. The pivot pin and the stop pin are positioned such that, and are spaced apart by a distance such that, when the pin portion is angled with respect to the saddle bracket portion at an insertion angle, the stop pin is positionable adjacent to the outer surface of the saddle bracket portion and the pivot pin is insertable into the inner pivot channel, and such that when the pin portion is angled with respect to the saddle bracket portion at an angle other than the insertion angle, the pivot pin is retained in the inner pivot channel. Once the pivot pin is inserted into the inner pivot channel, the pivot pin portion is pivotable with respect to the saddle bracket portion from an occupied position where the stop pin abuts the occupied position stop to an unoccupied position where the stop pin abuts the unoccupied position stop.

Preferably, the saddle bracket portion comprises part of a seat frame subassembly and the pin portion comprises part of a seat subassembly. It is also preferable that the saddle bracket portion is formed from a polymeric material, while the pin portion is formed from a metal, ceramic, polymer or a combination thereof.

The saddle bracket portion preferably includes a protective cap hingedly connected thereto which cap is movable from an open position wherein the pivot pin is insertable into the inner pivot channel to a closed position wherein the protective cap inhibits objects from falling into the inner pivot channel. Most preferably, the protective cap and the saddle bracket portion are integrally formed from a polymeric material.

Preferably, the pivot pin and the stop pin are substantially cylindrical. They may be of substantially the same size or of substantially different sizes. The unoccupied position stop preferably has attached thereto a bumper to inhibit noise and to inhibit bouncing when the stop pin contacts the unoccupied position stop. Most preferably, the outer surface of the saddle bracket portion includes a protuberance protruding outwardly therefrom adjacent to the unoccupied position stop such that the stop pin is trapped between the unoccupied position stop and the protuberance to inhibit bouncing when the stop pin contacts the unoccupied position stop. It is also preferable that the outer surface of the saddle bracket portion substantially defines an arc.

The invention and its particular features and advantages will become more apparent from the following detailed description considered with reference to the accompanying drawings.

DETAILED DESCRIPTION OF THE INVENTION

Figure 1:
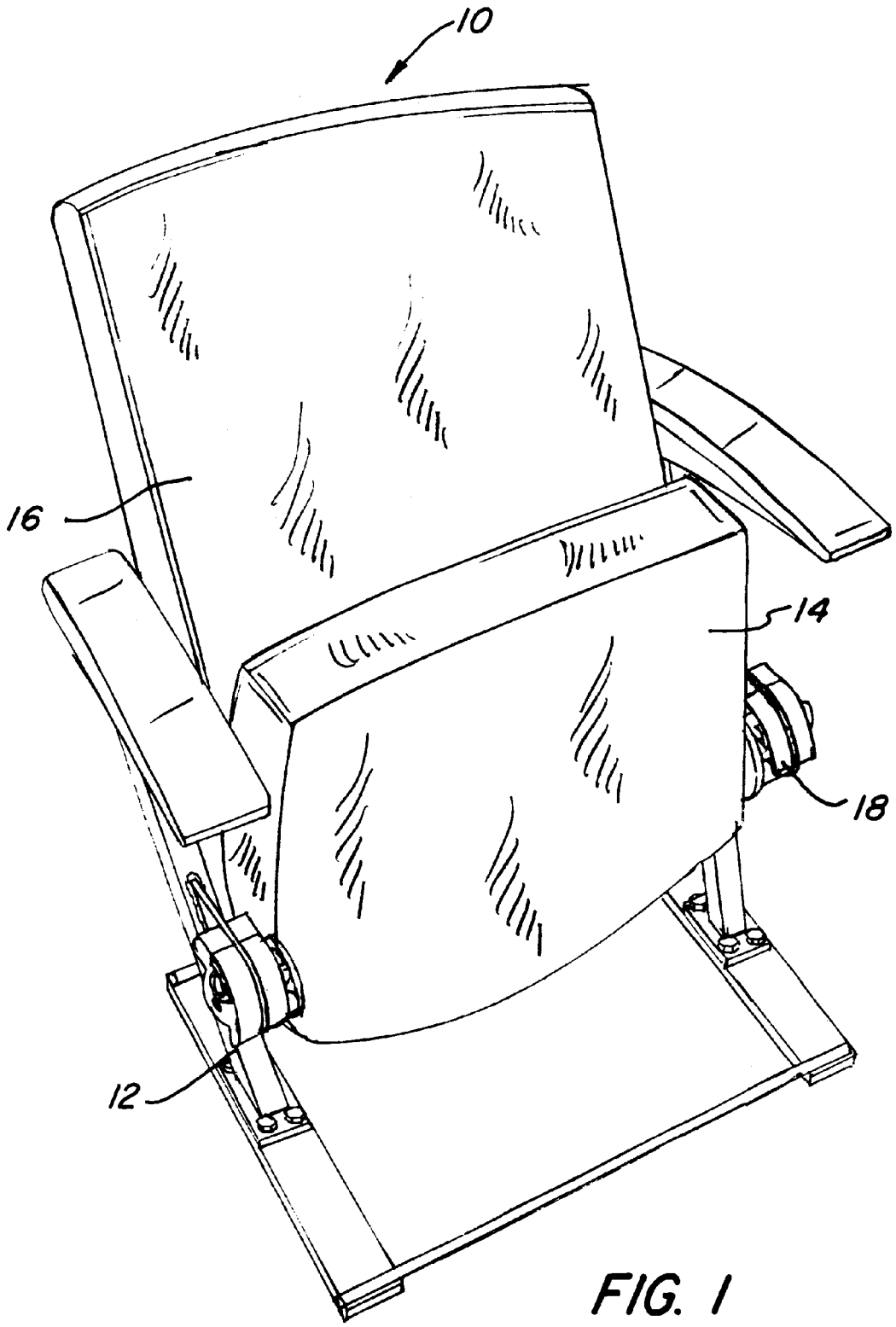
FIG. 1 is an isometric view of a seat assembly including a seat connection mechanism in accordance with the present invention shown in an unoccupied storage position.
Figure 2:
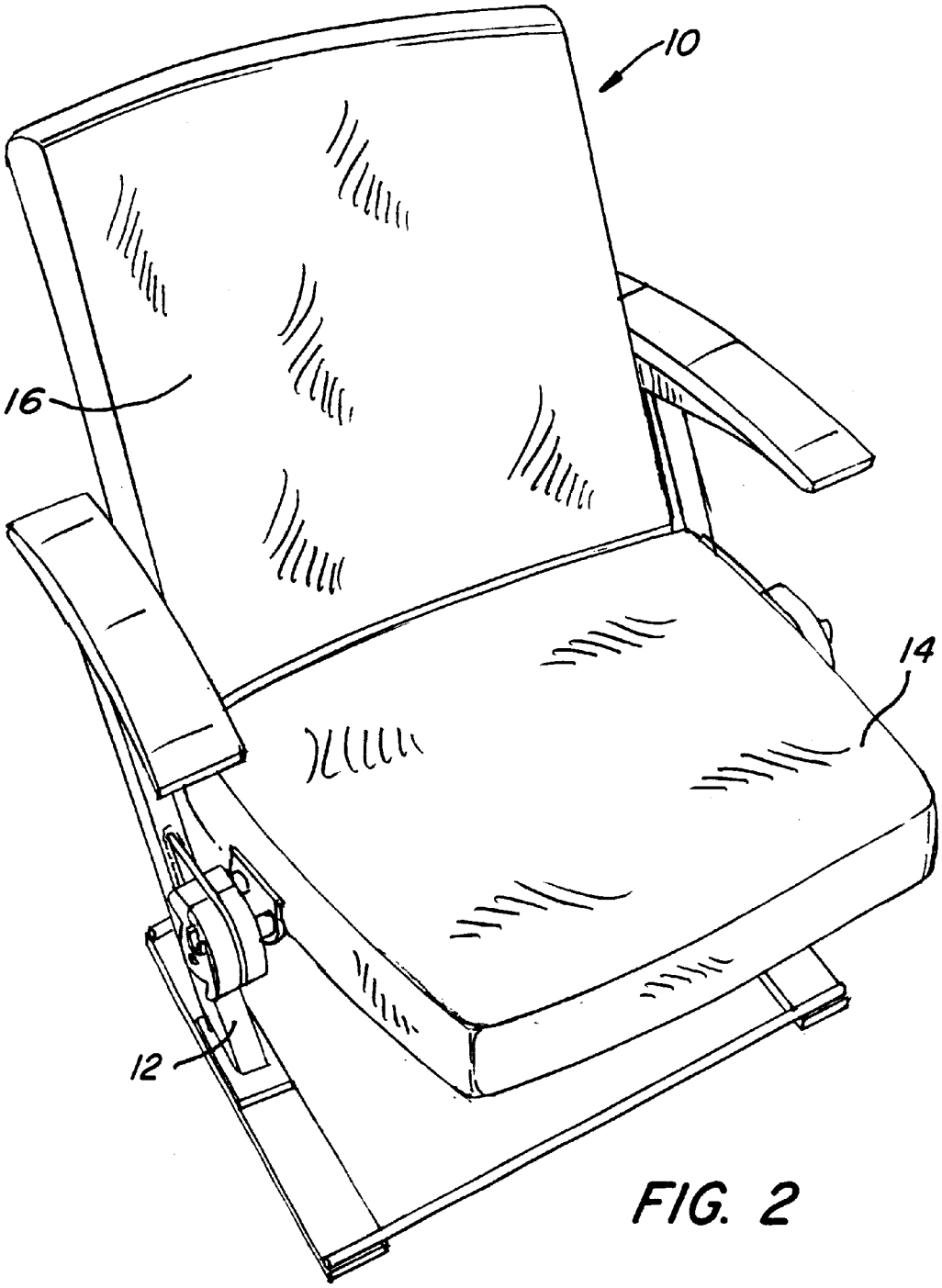
FIG. 2 is an isometric view of the seat assembly of FIG. 1 shown in an occupied position.

Referring first to FIGS. 1 and 2, a seating assembly 10, such as for use in an auditorium or theater, includes a pair of spaced frame assemblies 12, a seat 14 and a back 16, each of which is mounted between the frame assemblies 12. The seat 14 is mounted to the frame assemblies 12 by means of a seat connection mechanism, as is described in detail below, providing movement of the seat 14 between an occupied position (shown in FIG. 2) and an unoccupied, storage position (shown in FIG. 1) in which the seat is substantially vertical. A biasing arrangement, such as a counterweighted seat, moves the seat toward its storage position. The back 16 is mounted between the frame assemblies 12 by bolts, screws or the like.

Figure 3:
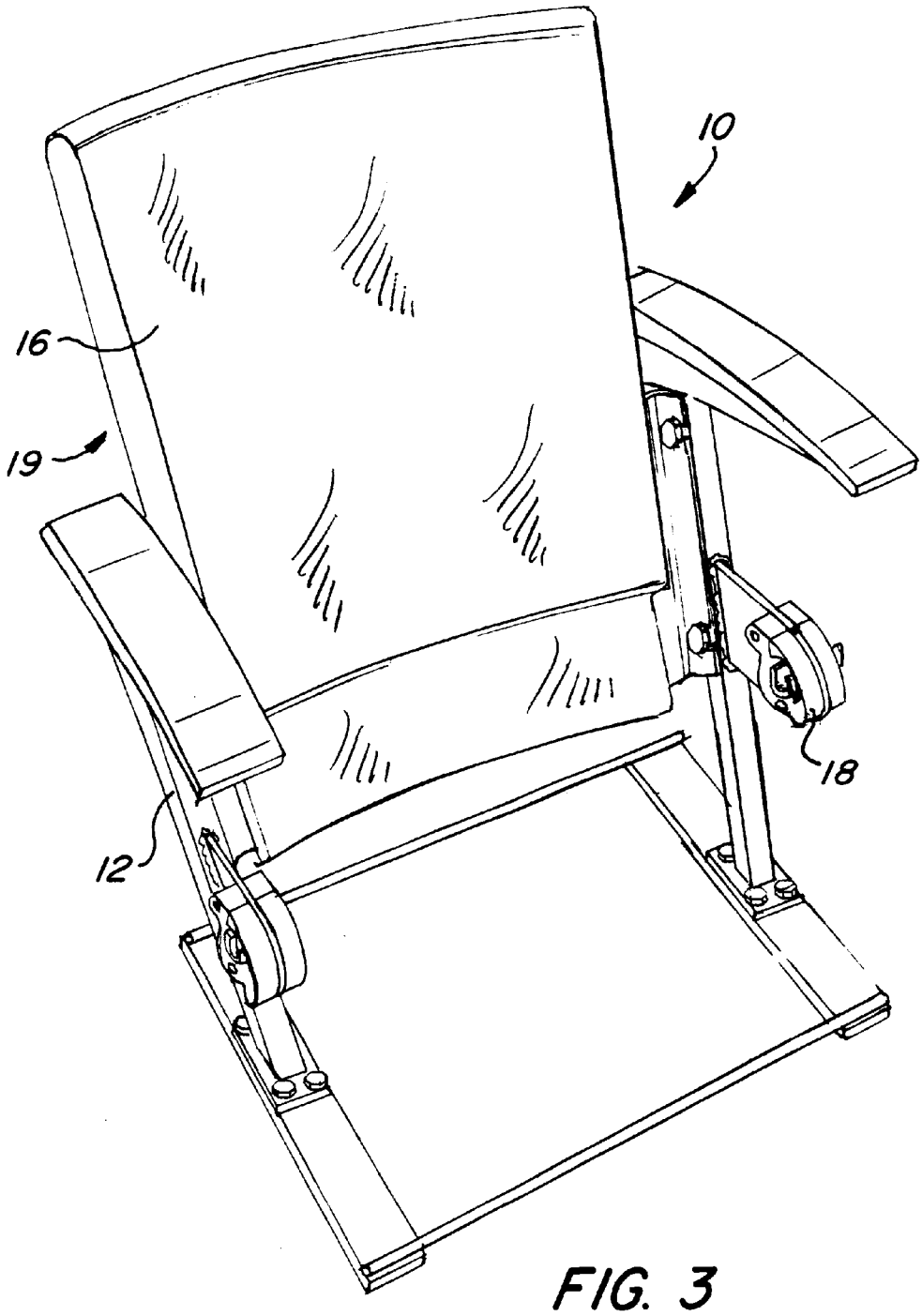
FIG. 3 is an isometric view of the frame and seat back portions of the seat assembly of FIG. 1.
Figure 4:
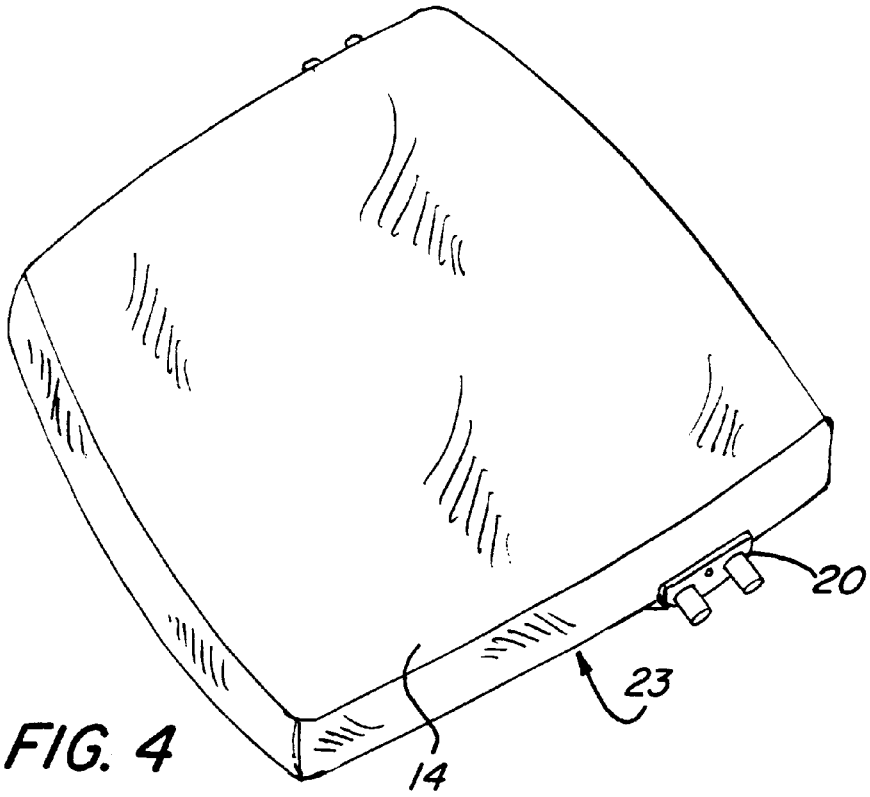
FIG. 4 is an isometric view of the seat portion of the seat assembly of FIG. 1.

The seat connection mechanism is generally comprised of two components: saddle bracket portion 18, which forms a part of the seat back and frame subassembly 19 (shown in FIG. 3), and pin portion 20, which forms a part of seat subassembly 23 (shown in FIG. 4). It should be noted that in the Figures, two saddle bracket portions are shown adjacent to each other, one for receiving the pin portion 20 of seat subassembly 23, and the other for receiving a pin portion of an adjacent seat assembly in a row of seats.

Figure 5:
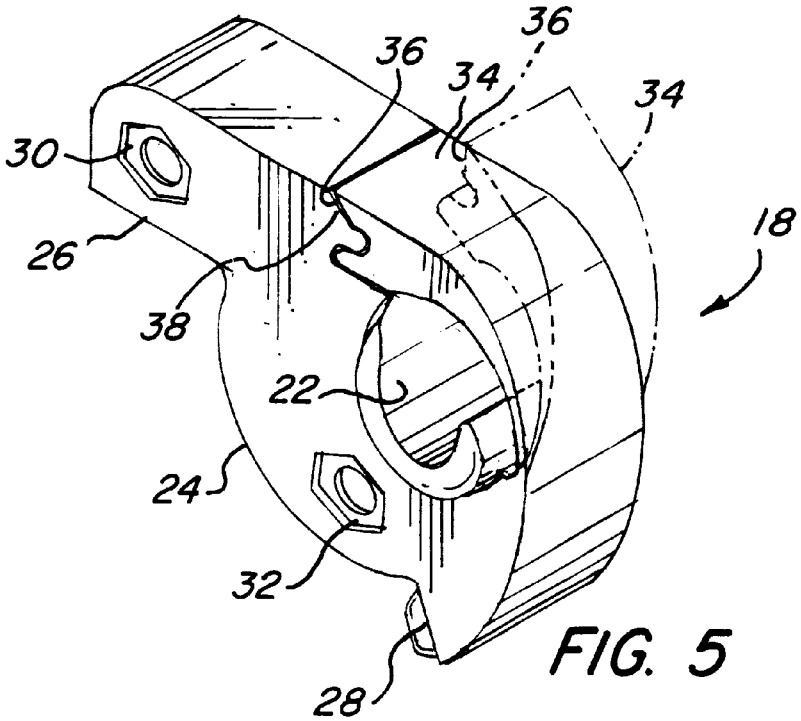
FIG. 5 is an isometric view of the saddle bracket portion of a seat connection mechanism in accordance with the present invention.

Referring now to FIG. 5, saddle bracket portion 18 of the inventive seat connection mechanism is shown in more detail. Saddle bracket portion 18 generally comprises a molded polymeric member having an inner pivot channel 22 and an outer surface 24 which extends between an occupied position stop 26 and an unoccupied position stop 28. Saddle bracket portion 18, which is preferably injected molded plastic, further includes two metal inserts 30, 32 designed to bear the weight of a person seated in seat assembly 10, thereby inhibiting the plastic from breaking and allowing the saddle bracket portion 18 to be screwed very tightly to frame 12 without damaging the plastic.

Saddle bracket portion 18 also preferably includes a protective cap 34 hingedly connected thereto. Most preferably, protective cap 34 is also formed of a polymeric material, and is integrally formed as part of saddle bracket portion 18. Protective cap 34 is movable from an open position (shown in phantom in FIG. 5) in which the pin portion 20 can be received therein (as more fully explained below), to a closed position (shown by solid lines in FIG. 5) in which pin portion 20 is retained thereby. Protective cap 34, in the closed position, acts to inhibit dirt, debris and other undesirable objects from falling into inner pivot channel 22 and from interfering with the operation of the connection mechanism. Protective cap 34 includes a quick action closure mechanism, generally comprising an interference fit between surface 36 of protective cap 34 and surface 38 of saddle bracket portion 18, making installation expeditious.

Figure 6:
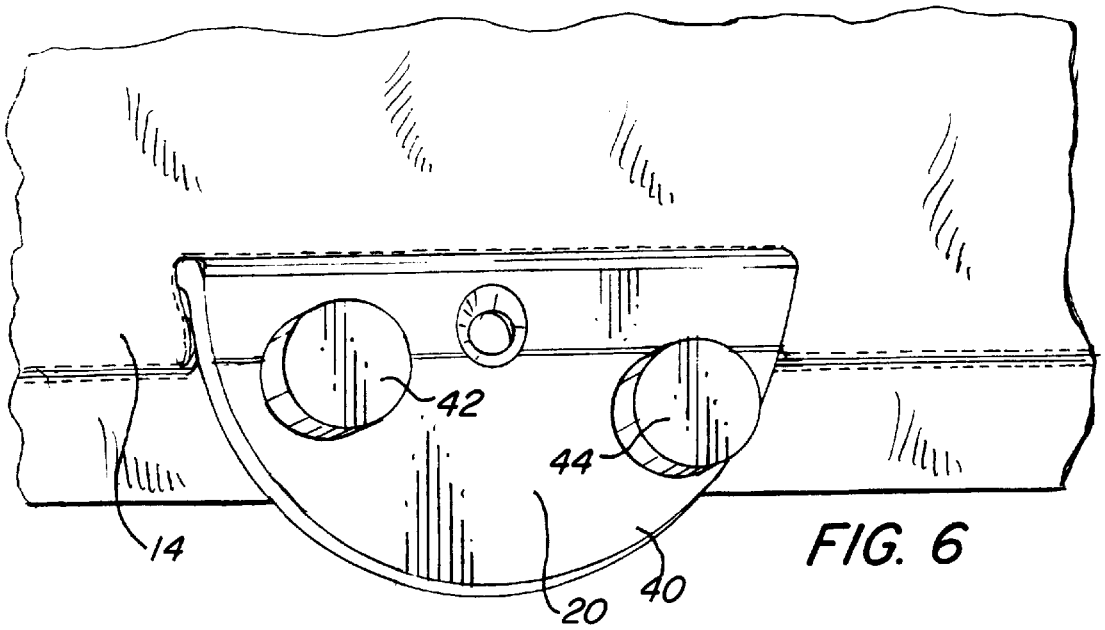
FIG. 6 is a plan view of the pin portion of a seat connection mechanism in accordance with the present invention.
Figure 7:
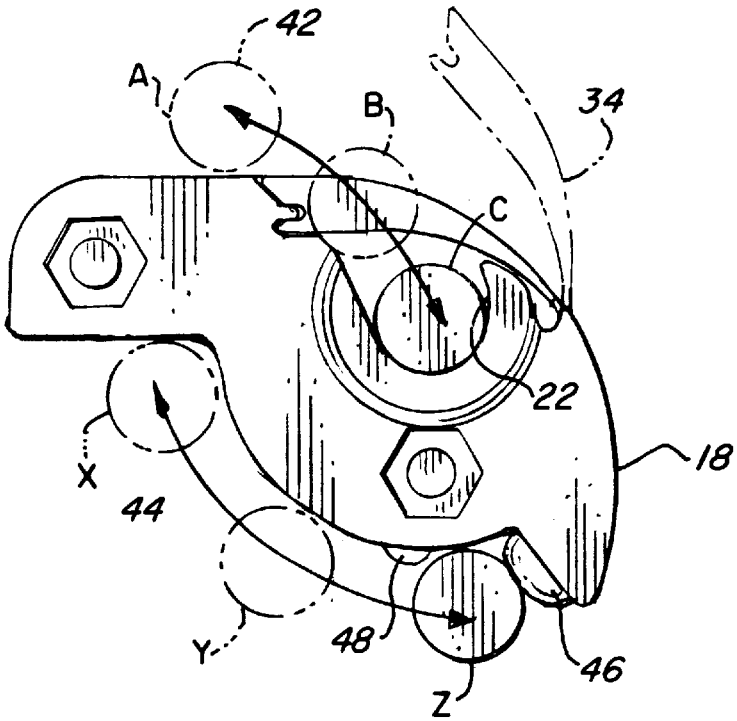
FIG. 7 is a plan view illustrating assembly, disassembly and operation of a seat connection mechanism in accordance with the present invention.

Referring now to FIG. 6, pin portion 20 of the inventive seat connection mechanism is shown in more detail. Pin portion 20 generally comprises a plate 40 connected to seat 14 having a pivot pin 42 and a stop pin 44. Preferably, pin portion 20 is formed from steel, or some other high strength metal, but may be formed from a polymeric or ceramic material so long as it has sufficient strength to support a person seated in seat assembly 10. Pivot pin 42 and stop pin 44 may define a plane parallel to the plane of seat 14, or may be offset, for example, for proper counterbalance such that seat 14 reverts to the storage position when no one is seated in seat assembly 10. Pivot pin 42 and stop pin 44 may be of substantially the same size (as shown in FIG. 6), or may be of different sizes (as shown in FIG. 7).

Figure 8:
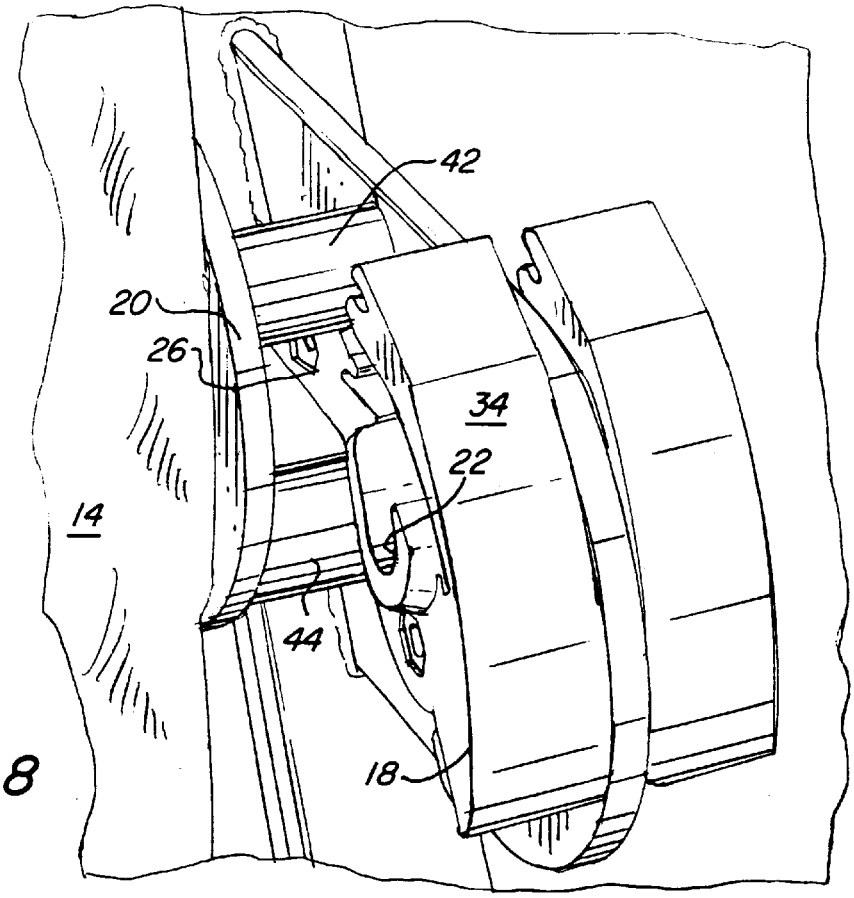
FIGS. 8–11 are isometric views showing assembly of a seat connection mechanism in accordance with the present invention.
Figure 9:
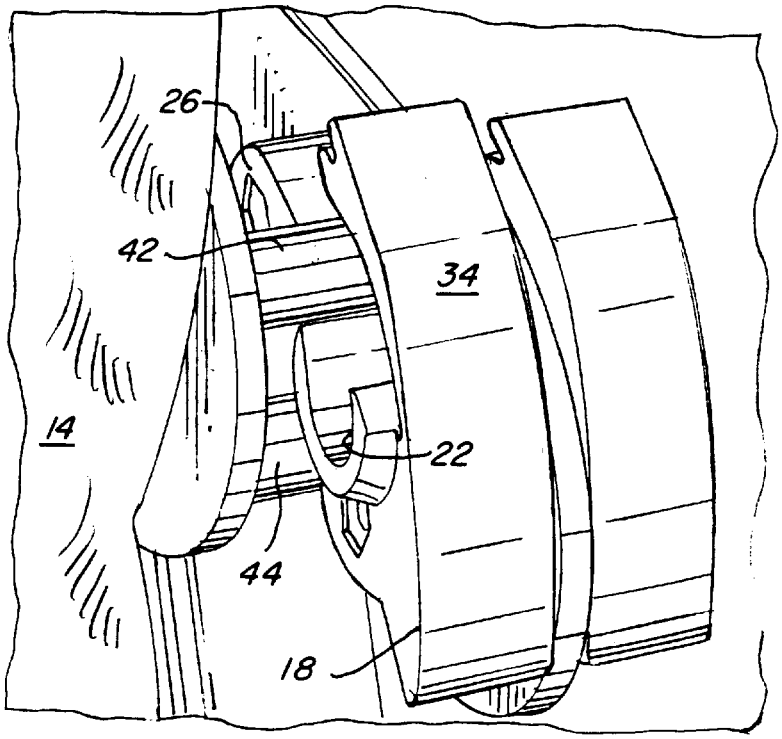
Figure 10:
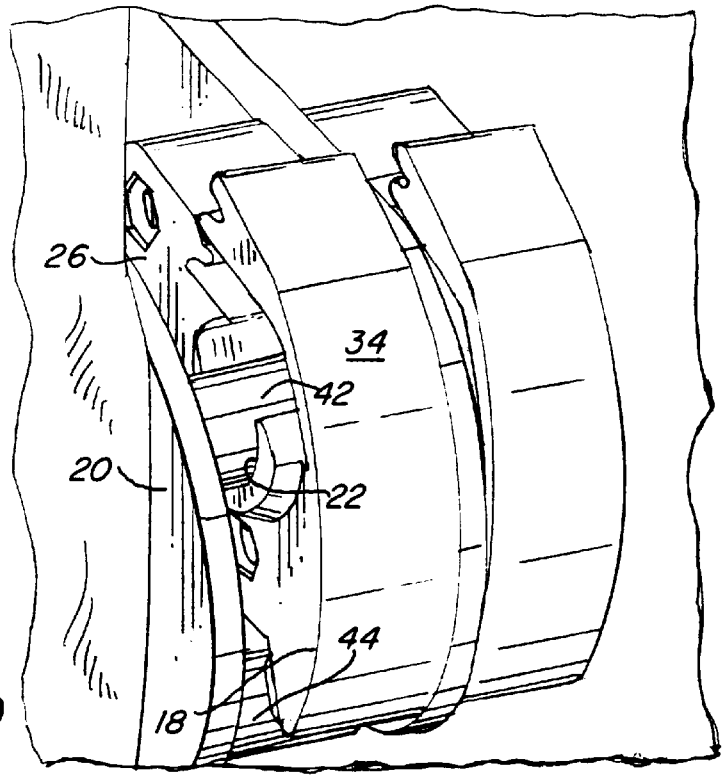
Figure 11:
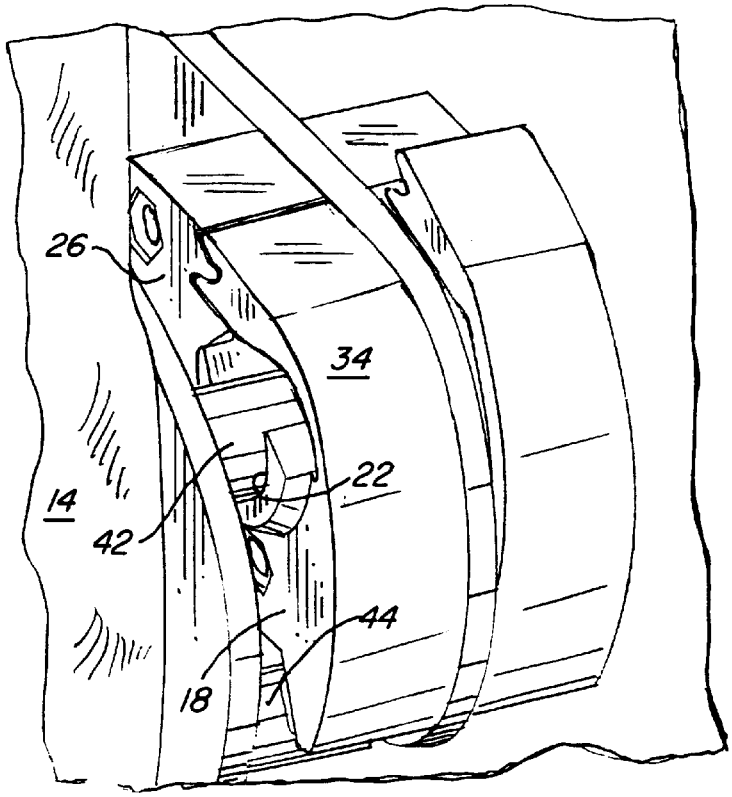

The inventive seat connection mechanism of the present invention has been designed such that assembly and disassembly is quick and easy, as illustrated in FIGS. 7–11. Referring first to FIG. 8 and to position A of pivot pin 42 in FIG. 7, seat 14 and thus pin portion 20 is pivoted to an insertion angle such that occupied position stop 26 of saddle bracket portion 18 can be slid through the space between pivot pin 42 and stop pin 44. It should, of course, be understood by one skilled in the art that more than a single discrete angle could be suitable for insertion, and that a range of angles may be appropriate. Thus, the term "insertion angle" used herein refers to the range of angles appropriate for insertion. Once at the proper angle, seat 14 and pin portion 20 are slid over occupied position stop 26 of saddle bracket portion 18 (shown in FIG. 9 and as position B in FIG. 7) until pivot pin 42 is brought fully into inner pivot channel 22 of saddle bracket portion 18 (shown in FIG. 10 and as position C in FIG. 7). At this point, protective cap 34 may be moved from the open position (shown in FIG. 10 and in phantom in FIG. 7) to the closed position (shown in FIG. 11 and as solid lines in FIG. 7).

The seat subassembly 23 may be removed from the frame subassembly 19 by reversing the assembly steps described above. However, it should be noted that the seat subassembly 23 can only be removed if the person attempting to disassemble the unit knows that disassembly can occur if the seat is pivoted to a proper angle. As such, the disassembly procedure would not be obvious to the general public. Moreover, no tools are necessary for assembly or disassembly. All that is required for opening protective cap 34 is to exert an opening pressure thereon.

Moreover, it should be noted that seat assemblies having different widths may be easily accommodated simply by varying the width of saddle bracket portion 18, without having to vary the design thereof. This allows components of the seat assemblies (i.e., standards, seats and backs) having the same widths to be used in creating seat assemblies having varying widths, allowing for very low inventory of the seat components. On site, adjustments of the widths of the seat assemblies can be made without replacing major components.

Once assembled, the seat 14 is pivotable from an occupied position (shown in FIG. 2 and as position X in FIG. 7) through position Y shown in FIG. 7, and to an unoccupied, storage position (shown in FIG. 1 and as position Z in FIG. 7) in which the seat is substantially vertical. In the occupied position, stop pin 44 abuts occupied position stop 26 of saddle bracket portion 18 which prevents the seat from pivoting further past the substantially horizontal position. When the seat is vacated, a biasing arrangement, such as a counterweighted seat, moves the seat toward its storage position in which stop pin 44 abuts unoccupied position stop 28 of saddle bracket portion 18.

Because stop pin 44 may contact unoccupied position stop 28 with some force, unoccupied position stop 28 is provided with a bumper 46 of rubber or the like to inhibit noise and to inhibit the seat from bouncing to a stop when a person leaves the seat, instead creating a substantially noiseless seat that quickly comes to a complete stop when vacated. The width of bumper 46 may be varied in order to vary the angle to which seat 14 reverts in the unoccupied, storage position, as will be understood by those skilled in the art.

Saddle bracket portion 18 preferably further includes a protuberance 48 on outer surface 24 toward occupied position stop 26. Protuberance 48 extends from outer surface 24 to such an extend that as stop pin 44 travels therepast, it contacts protuberance 48 to an extent sufficient to impede movement thereof, but not to such an extent that stop pin 44 is prevented from traveling past protuberance 48. Thus, when the seat is vacated and the seat moves toward its storage position in which stop pin 44 contacts unoccupied position stop 28 of saddle bracket portion 18, stop pin 44 is inhibited from bouncing off of bumper 46 by protuberance 48. Thus, stop pin 44 is trapped between bumper 46 and protuberance 48. However, by exerting a minimal force, stop pin 44 may be pivoted past protuberance 48 to bring the seat to the occupied position.

Figure 12:
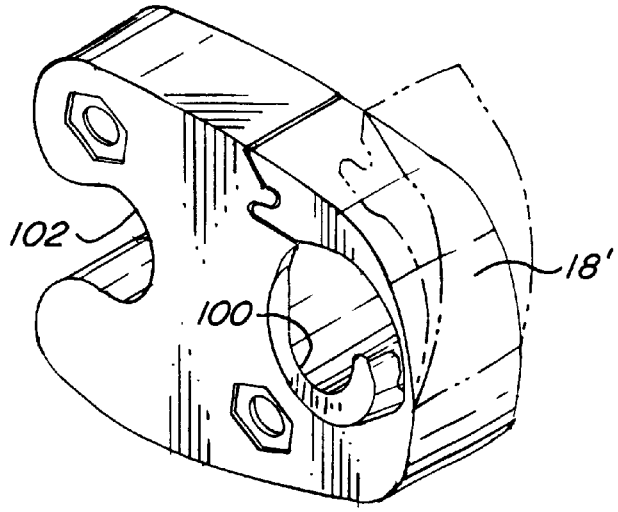
FIG. 12 is an isometric view illustrating a saddle bracket portion of a seat connection mechanism in accordance with another embodiment of the present invention.
Figure 14:
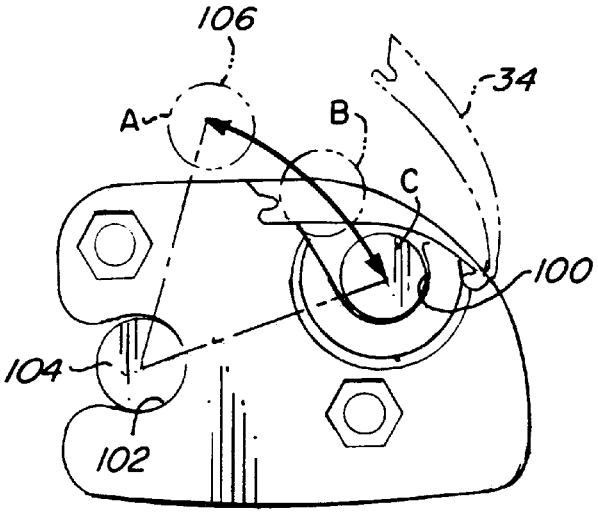
FIGS. 13 and 14 are plan views illustrating operation of the saddle bracket portion of a seat connection mechanism of FIG. 12.
Figure 13:
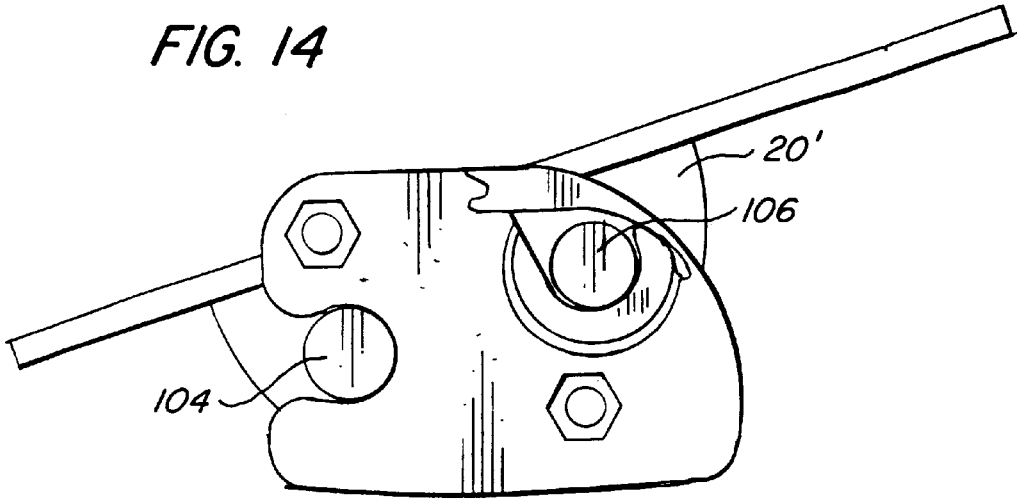

Referring now to FIGS. 12–14, an embodiment of saddle bracket portion 18' in accordance with another embodiment of the invention is shown. This embodiment is similar to the embodiment described above and offers similar benefits, with the exception that the seat, once installed, is fixed rather than pivotable.

Rather than having an inner pivot channel 22 and an outer surface 24 which extends between an occupied position stop 26 and an unoccupied position stop 28, saddle bracket portion 18' includes an upper channel 100 and a rear channel 102, each of which receive a pin 104, 106 of corresponding pin portion 20'. Referring now specifically to FIG. 14, in order to assemble the seat assembly of this embodiment, pin 104 is first inserted into rear channel 102 with the seat, and thus pin portion 20' and pin 106 being tilted upwardly (shown as position A). Seat and is then pivoted downwardly such that pin 106 travels through position B to position C wherein pin 106 is located within upper channel 100. Finally, protective cap 34 is closed as described in detail above.

Preferably, channel 102 has an opening with a decreased width as compared to the remainder of channel 102 (as best seen in FIG. 13), such that pin 104 is snap fit within channel 102.

The present invention, therefore, provides a seat connection mechanism which does not require complex assembly and disassembly procedures, which does not employ a procedure for seat removal which is obvious to the general public, which has few components, and which inhibits undesirable objects from interfering with the operation thereof.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A seat connection mechanism comprising:

a saddle bracket portion comprising an inner pivot channel, an occupied position stop, an unoccupied position stop, and an outer surface which extends between the occupied position stop and the unoccupied position stop;

a pin portion comprising a pivot pin and a stop pin protruding therefrom;

wherein the pivot pin and the stop pin are positioned such that, and are spaced apart by a distance such that, when said pin portion is angled with respect to said saddle bracket portion at an insertion angle, the stop pin is positionable adjacent to the outer surface of said saddle bracket portion and the pivot pin is insertable into and removable from the inner pivot channel, and such that when said pin portion is angled with respect to said saddle bracket portion at an angle other than the insertion angle, the pivot pin is retained in the inner pivot channel; and wherein once the pivot pin is inserted into the inner pivot channel, said pin portion is pivotable with respect to said saddle bracket portion from an occupied position where the stop pin abuts the occupied position stop to an unoccupied position where the stop pin abuts the unoccupied position stop.

2. The seat connection mechanism of claim 1 wherein the saddle bracket portion comprises part of a seat frame subassembly and the pin portion comprises part of a seat subassembly.

3. The seat connection mechanism of claim 1 wherein the saddle bracket portion is formed from a polymeric material.

4. The seat connection mechanism of claim 1 wherein the pin portion is formed from a material selected from the group consisting of metals, ceramics, polymers and combinations of these.

5. The seat connection mechanism of claim 1 wherein the saddle bracket portion further comprises a protective cap hingedly connected thereto and movable from an open position wherein the pivot pin is insertable into the inner pivot channel to a closed position wherein the protective cap inhibits objects from falling into the inner pivot channel.

6. The seat connection mechanism of claim 5 wherein the saddle bracket portion and the protective cap are integrally formed from a polymeric material.

7. The seat connection mechanism of claim 1 wherein the pivot pin and the stop pin are substantially cylindrical.

8. The seat connection mechanism of claim 7 wherein the pivot pin and the stop pin are of substantially the same size.

9. The seat connection mechanism of claim 7 wherein the pivot pin and the stop pin are of substantially different sizes.

10. The seat connection mechanism of claim 1 wherein the unoccupied position stop has attached thereto a bumper to inhibit noise and to inhibit bouncing when the stop pin contacts the unoccupied position stop.

11. The seat connection mechanism of claim 1 wherein the outer surface of said saddle bracket portion includes a protuberance protruding outwardly therefrom adjacent to the unoccupied position stop such that the stop pin is trapped between the unoccupied position stop and the protuberance to inhibit bouncing when the stop pin contacts the unoccupied position stop.

12. The seat connection mechanism of claim 1 wherein the outer surface of said saddle bracket portion substantially defines an arc.

13. A seat connection mechanism comprising:

a saddle bracket portion comprising an inner pivot channel, an occupied position stop, an unoccupied position stop, an arc-shaped outer surface which extends between the occupied position stop and the unoccupied position stop, and a protective cap hingedly connected thereto;

a pin portion comprising a substantially cylindrical pivot pin and a substantially cylindrical stop pin protruding therefrom;

wherein the pivot pin and the stop pin are positioned such that, and are spaced apart by a distance such that, when said pin portion is angled with respect to said saddle bracket portion at an insertion angle, the stop pin is positionable adjacent to the outer surface of said saddle bracket portion and the pivot pin is insertable into the inner pivot channel, and such that when said pin portion is angled with respect to said saddle bracket portion at an angle other than the insertion angle, the pivot pin is retained in the inner pivot channel;

wherein once the pivot pin is inserted into the inner pivot channel, said pin portion is pivotable with respect to said saddle bracket portion from an occupied position where the stop pin abuts the occupied position stop to an unoccupied position where the stop pin abuts the unoccupied position stop;

wherein the protective cap is movable from an open position wherein the pivot pin is insertable into the inner pivot channel to a closed position wherein the protective cap inhibits objects from falling into the inner pivot channel; and wherein the outer surface of said saddle bracket portion includes a protuberance protruding outwardly therefrom adjacent to the unoccupied position stop such that the stop pin is trapped between the unoccupied position stop and the protuberance to inhibit bouncing when the stop pin contacts the unoccupied position stop.

14. The seat connection mechanism of claim 13 wherein the saddle bracket portion comprises part of a seat frame subassembly and the pin portion comprises part of a seat subassembly.

15. The seat connection mechanism of claim 13 wherein the saddle bracket portion is formed from a polymeric material.

16. The seat connection mechanism of claim 13 wherein the pin portion is formed from a material selected from the group consisting of metals, ceramics, polymers and combinations of these.

17. The seat connection mechanism of claim 13 wherein the pivot pin and the stop pin are of substantially the same size.

18. The seat connection mechanism of claim 13 wherein the pivot pin and the stop pin are of substantially different sizes.

19. The seat connection mechanism of claim 13 wherein the unoccupied position stop has attached thereto a bumper to inhibit noise and to inhibit bouncing when the stop pin contacts the unoccupied position stop.

20. A seat assembly comprising:

a seat frame subassembly comprising a seat frame, a seat back, and a saddle bracket portion, the saddle bracket portion having an inner pivot channel, an occupied position stop, an unoccupied position stop, and an arc-shaped outer surface which extends between the occupied position stop and the unoccupied position stop;

a seat subassembly comprising a seat and a pin portion, the pin portion comprising a pivot pin and a stop pin protruding therefrom;

wherein the pivot pin and the stop pin are positioned such that, and are spaced apart by a distance such that, when said seat subassembly is angled with respect to said seat frame subassembly at an insertion angle, the stop pin is positionable adjacent to the outer surface of the saddle bracket portion and the pivot pin is insertable into and removable from the inner pivot channel, and such that when said seat subassembly is angled with respect to said seat frame subassembly at an angle other than the insertion angle, the pivot pin is retained in the inner pivot channel; and wherein once the pivot pin is inserted into the inner pivot channel, said seat subassembly is pivotable with respect to said seat frame subassembly from an occupied position where the stop pin abuts the occupied position stop and where the seat is substantially perpendicular to the seat back to an unoccupied position where the stop pin abuts the unoccupied position stop and where the seat is substantially parallel to the seat back.

21. The seat assembly of claim 20 wherein the saddle bracket portion is formed from a polymeric material.

22. The seat assembly of claim 20 wherein the pin portion is formed from a material selected from the group consisting of metals, ceramics, polymers and combinations of these.

23. The seat assembly of claim 20 wherein the saddle bracket portion further comprises a protective cap hingedly connected thereto and movable from an open position wherein the pivot pin is insertable into the inner pivot channel to a closed position wherein the protective cap inhibits objects from falling into the inner pivot channel.

24. The seat assembly of claim 23 wherein the saddle bracket portion and the protective cap are integrally formed from a polymeric material.

25. The seat assembly of claim 20 wherein the pivot pin and the stop pin are substantially cylindrical.

26. The seat assembly of claim 25 wherein the pivot pin and the stop pin are of substantially the same size.

27. The seat assembly of claim 26 wherein the pivot pin and the stop pin are of substantially different sizes.

28. The seat assembly of claim 20 wherein the unoccupied position stop has attached thereto a bumper to inhibit noise and to inhibit bouncing when the stop pin contacts the unoccupied position stop.

29. The seat assembly of claim 28 wherein the size of the bumper is variable in order to vary the angle of the seat with respect to the seat back when in the unoccupied position.

30. The seat assembly of claim 20 wherein the outer surface of said saddle bracket portion includes a protuberance protruding outwardly therefrom adjacent to the unoccupied position stop such that the stop pin is trapped between the unoccupied position stop and the protuberance to inhibit bouncing when the stop pin contacts the unoccupied position stop.

31. The seat assembly of claim 20 wherein the pivot pin and the stop pin define a plane which is not substantially parallel to the seat.

32. The seat assembly of claim 20 wherein the width of the saddle bracket portion is variable in order to accommodate seat assemblies having varying widths.

33. A seat connection mechanism comprising:

a saddle bracket portion comprising an inner pivot channel and an outer surface;

a pin portion comprising a first pin and a second pin protruding therefrom; and wherein the first pin and the second pin are positioned such that, and are spaced apart by a distance such that, when said pin portion is angled with respect to said saddle bracket portion at an insertion angle, the second pin is positionable adjacent to the outer surface of said saddle bracket portion and the first pin is insertable into and removable from the inner pivot channel, and such that when said pin portion is angled with respect to said saddle bracket portion at an angle other than the insertion angle, the first pin is retained in the inner pivot channel.

34. The seat connection mechanism of claim 33 wherein once the first pin is inserted into the inner pivot channel, said pin portion is pivotable with respect to said saddle bracket portion from an occupied position to an unoccupied position.

35. The seat connection mechanism of claim 33 wherein the saddle bracket portion comprises part of a seat frame subassembly and the pin portion comprises part of a seat subassembly.

36. The seat connection mechanism of claim 33 wherein the saddle bracket portion is formed from a polymeric material.

37. The seat connection mechanism of claim 33 wherein the pin portion is formed from a material selected from the group consisting of metals, ceramics, polymers and combinations of these.

38. The seat connection mechanism of claim 33 wherein the saddle bracket portion further comprises a protective cap hingedly connected thereto and movable from an open position wherein the first pin is insertable into the inner pivot channel to a closed position wherein the protective cap inhibits objects from falling into the inner pivot channel.

39. The seat connection mechanism of claim 38 wherein the saddle bracket portion and the protective cap are integrally formed from a polymeric material.

40. The seat connection mechanism of claim 33 wherein the first pin and the second pin are substantially cylindrical.

41. The seat connection mechanism of claim 40 wherein the first pin and the second pin are of substantially the same size.

42. The seat connection mechanism of claim 33 wherein the outer surface of said saddle bracket portion substantially defines an arc.

43. A seat connection mechanism comprising:

a saddle bracket portion comprising an inner pivot channel;

a pin portion comprising a pin protruding therefrom; and wherein when said pin portion is angled with respect to said saddle bracket portion at an insertion angle, the pin is insertable into and removable from the inner pivot channel, and such that when said pin portion is angled with respect to said saddle bracket portion at an angle other than the insertion angle, the pin is retained in the inner pivot channel.

44. The seat connection mechanism of claim 43 wherein once the pin is inserted into the inner pivot channel, said pin portion is pivotable with respect to said saddle bracket portion from an occupied position to an unoccupied position.

45. The seat connection mechanism of claim 43 wherein the saddle bracket portion comprises part of a seat frame subassembly and the pin portion comprises part of a seat subassembly.

46. The seat connection mechanism of claim 43 wherein the saddle bracket portion is formed from a polymeric material.

47. The seat connection mechanism of claim 43 wherein the pin portion is formed from a material selected from the group consisting of metals, ceramics, polymers and combinations of these.

48. The seat connection mechanism of claim 43 wherein the saddle bracket portion further comprises a protective cap hingedly connected thereto and movable from an open position wherein the pin is insertable into the inner pivot channel to a closed position wherein the protective cap inhibits objects from falling into the inner pivot channel.

49. The seat connection mechanism of claim 48 wherein the saddle bracket portion and the protective cap are integrally formed from a polymeric material.

50. The seat connection mechanism of claim 43 wherein the pin is substantially cylindrical.

* * * * *